US010012442B2

(12) United States Patent
Yang et al.

(10) Patent No.: US 10,012,442 B2
(45) Date of Patent: Jul. 3, 2018

(54) DEVICE FOR PRODUCING SEMI-SOLID SLURRY

(71) Applicant: Nanchang University, Nanchang (CN)

(72) Inventors: Xiangjie Yang, Nanchang (CN); Chiwei Huang, Nanchang (CN); Xubo Liu, Nanchang (CN); Hongmin Guo, Nanchang (CN)

(73) Assignee: Nanchang University, Nanchang (CN)

( * ) Notice: Subject to any disclaimer, the term of this patent is extended or adjusted under 35 U.S.C. 154(b) by 94 days.

(21) Appl. No.: 15/202,544

(22) Filed: Jul. 5, 2016

(65) Prior Publication Data

US 2016/0313062 A1 Oct. 27, 2016

Related U.S. Application Data

(63) Continuation-in-part of application No. PCT/CN2014/092586, filed on Nov. 28, 2014.

(30) Foreign Application Priority Data

Jan. 23, 2014 (CN) ..... 2014 1 0031466

(51) Int. Cl.
*F27B 9/14* (2006.01)
*B01F 15/06* (2006.01)
(Continued)

(52) U.S. Cl.
CPC ..... *F27B 9/147* (2013.01); *B01F 9/001* (2013.01); *B01F 9/04* (2013.01); *B01F 15/065* (2013.01); *F27B 7/06* (2013.01); *F27B 7/20* (2013.01); *F27B 7/34* (2013.01); *F27B 7/38* (2013.01); *F27B 7/383* (2013.01); *F27B 7/386* (2013.01); *F27B 7/42* (2013.01); *F27B 9/30* (2013.01); *F27D 9/00* (2013.01); *F27D 11/06* (2013.01);
(Continued)

(58) Field of Classification Search
CPC ..... B22D 17/007; B22D 17/30; F27B 9/147
See application file for complete search history.

(56) References Cited

U.S. PATENT DOCUMENTS

2001/0045266 A1* 11/2001 Kono ..... B22D 17/007 164/113
2009/0000758 A1* 1/2009 Stone ..... B22D 17/007 164/316
(Continued)

*Primary Examiner* — Scott Kastler
(74) *Attorney, Agent, or Firm* — Rankin, Hill & Clark LLP

(57) ABSTRACT

A device for producing semi-solid slurry, including a height adjustment mechanism, a position adjustment mechanism, a melt protection mechanism, a support mechanism, a revolving pipe, guide mechanisms, thermally-adapted elastic supports, a driving mechanism of the revolving pipe, and a cooling module. The height adjustment mechanism is a box structure including an upper casing and a lower casing. The position adjustment mechanism includes a stationary rail and a moving rail support, and the stationary rail is fixed on the upper casing of the height adjustment mechanism. The melt protection mechanism includes a seal box including a base plate fixed on the moving rail support. The support mechanism includes a main support frame and an angle adjustment bracket, the main support frame is fixed on the base plate of the seal box, and the angle adjustment bracket is mounted on the main support frame.

10 Claims, 6 Drawing Sheets

(51) Int. Cl.

| | |
|---|---|
| ***F27D 27/00*** | (2010.01) |
| ***F27B 9/30*** | (2006.01) |
| ***B01F 9/00*** | (2006.01) |
| ***B01F 9/04*** | (2006.01) |
| ***F27B 7/06*** | (2006.01) |
| ***F27B 7/20*** | (2006.01) |
| ***F27B 7/34*** | (2006.01) |
| ***F27B 7/38*** | (2006.01) |
| ***F27B 7/42*** | (2006.01) |
| ***F27D 11/06*** | (2006.01) |
| *F27D 9/00* | (2006.01) |

(52) U.S. Cl.
CPC ..... *F27D 27/00* (2013.01); *B01F 2009/0063* (2013.01); *B01F 2009/0065* (2013.01); *B01F 2015/061* (2013.01); *F27D 2009/0002* (2013.01)

(56) References Cited

U.S. PATENT DOCUMENTS

2011/0180228 A1* 7/2011 Sakai ..... B22D 17/30
164/80
2016/0313062 A1* 10/2016 Yang ..... F27B 9/147

* cited by examiner

DEVICE FOR PRODUCING SEMI-SOLID SLURRY

CROSS-REFERENCE TO RELATED APPLICATIONS

This application is a continuation-in-part of International Patent Application No. PCT/CN2014/092586 with an international filing date of Nov. 28, 2014, designating the United States, now pending, and further claims priority benefits to Chinese Patent Application No. 201410031466.8 filed Jan. 23, 2014. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a device for producing semi-solid slurry.

Description of the Related Art

Typical methods for producing semi-solid slurry include mechanical mixing, electromagnetic stirring, ultrasonic vibration, grain refinement, and so on. Each method involves corresponding production equipment. However, the production equipment produces batches of slurry, which reduces the production efficiency. Typically, the production process is open, and the final product is contaminated by air.

SUMMARY OF THE INVENTION

In view of the above-described problems, it is one objective of the invention to provide a device for producing semi-solid slurry that can continuously produce slurry with high efficiency.

To achieve the above objective, in accordance with one embodiment of the invention, there is provided a device for producing semi-solid slurry, comprising:

- a height adjustment mechanism, the height adjustment mechanism being a box structure comprising an upper casing and a lower casing;
- a position adjustment mechanism, the position adjustment mechanism comprising a stationary rail and a moving rail support, the stationary rail being fixed on the upper casing of the height adjustment mechanism;
- a melt protection mechanism, the melt protection mechanism comprising a seal box comprising a base plate fixed on the moving rail support;
- a support mechanism, the support mechanism comprising a main support frame and an angle adjustment bracket, the main support frame being fixed on the base plate of the seal box, and the angle adjustment bracket being mounted on the main support frame;
- a revolving pipe, the revolving pipe comprising a material inlet and a material outlet and being supported by a support system, the support system comprising a front pillar, a rear pillar, and four guide wheels; the four guide wheels being hinged to the front pillar and the rear pillar, respectively; the revolving pipe being supported by the four guide wheels and tilted so that one end of the revolving pipe closed to the material inlet is higher than another end of the revolving pipe closed to the material outlet; the front pillar and the rear pillar being fixed on an installation platform of the angle adjustment bracket;
- guide mechanisms, the guide mechanisms being disposed on the front pillar and the rear pillar, and communicating with the material inlet and the material outlet of the revolving pipe, respectively;
- thermal-adaptation elastic supports, the thermal-adaptation elastic supports being disposed on the front pillar and the rear pillar, respectively, the thermal-adaptation elastic supports comprising an elastic guide wheel which is in an elastic contact with an outer wall of the revolving pipe;
- a driving mechanism for driving the revolving pipe, the driving mechanism being fixed on the installation platform and connected to and driving the revolving pipe; and
- a cooling module, the cooling module being disposed on the installation platform and distributed along an axial direction of the revolving pipe.

In a class of this embodiment, the upper casing and the lower casing of the height adjustment mechanism are fixed together through guide pillars, guide sleeves, and location pins.

In a class of this embodiment, the moving rail support is soldered on the base plate of the seal box; and the stationary rail and the moving rail support constitute a guide pair.

In a class of this embodiment, the seal box of the melt protection mechanism further comprises a shell, an airtight entrance door, and an airtight exit door; the base plate and the moving rail support are integrated through soldering; the airtight exit door is located at a front end of the base plate; the shell and the base plate are assembled to form a seal box body, two opposite sides of the seal box body are provided with two air inlets, respectively; the airtight entrance door is disposed on an upper surface of the cove; one side of the entrance door and one side of the airtight exit door each are provided with a drive cylinder.

In a class of this embodiment, the angle adjustment bracket comprises a front end and a rear end, the front end is hinged to the main support frame via a pin, and the rear end is fixed in an arc groove of the main support frame via a positioning bolt.

In a class of this embodiment, an axial locating disc is soldered on the revolving pipe to axially locate the revolving pipe; one side face of each of two guide wheels hinged to the front pillar contacts one side face of the axial locating disc; and heating rings are sleeved on the outer wall of the revolving pipe in sections.

In a class of this embodiment, the guide mechanisms comprise a feeding guide device and a discharging guide device; the feeding guide device is fixed on the rear pillar and communicates with the material inlet of the revolving pipe, and comprises a first heating resistor inside; the discharging guide device is fixed on the front pillar and communicates with the material outlet of the revolving pipe, and comprises a second heating resistor inside.

In a class of this embodiment, the driving mechanism for driving the revolving pipe comprises a servo motor fixed on the angle adjustment bracket, a bevel pinion 82 disposed on a rotating shaft of the servo motor, and a bevel gear disposed on a gear mounting plate soldered on the revolving pipe.

In a class of this embodiment, the thermal-adaptation elastic supports are two in number and are disposed on the front pillar and the rear pillar, respectively; each thermal-adaptation elastic support comprises the elastic guide wheel, a wheel support, and a fixed support of the elastic guide wheel; the elastic guide wheel is hinged to the fixed support and contacts the outer wall of the revolving pipe; the wheel support is disposed on the fixed support; the fixed support of the elastic guide wheel is fixed on the front pillar and the rear pillar.

In a class of this embodiment, two sets of the cooling module are fixed in segments on the installation platform along the axial direction of the revolving pipe; the cooling module comprises a cooling water tank, a spray pipe, and a water fender; the cooling water tank is fixed on the installation platform along the axial direction of the revolving pipe; the spray pipe is disposed in the cooling water tank along a circumferential direction of the revolving pipe; and the water fender is soldered on the revolving pipe.

The working process of the device for producing semi-solid slurry according to embodiments of the invention are summarized as follows:

Prior to pouring high temperature metal melt to the device for producing semi-solid slurry, the position of the device for producing semi-solid slurry are adjusted using the height adjustment mechanism and the position adjustment mechanism to be proper for working. Thereafter, the feeding guide device, the revolving pipe, and the discharging guide device are preheated to a present temperature. The servo motor is initiated to drive the revolving pipe to rotate or swing. When the opposite-type sensor detects the approaching of a pouring ladle to the airtight entrance door of the seal box, the drive cylinders drive the airtight entrance door and the airtight exit door to open synchronously, and the high temperature metal melt are dumped into the feeding guide device from the pouring ladle. Since the revolving pipe is tilted with the inlet thereof is higher than the outlet thereof, due to the gravity of the metal melt and the shear force produced by the rotation of the revolving pipe, the metal melt is rolling and stirred strongly in the revolving pipe, and continuously flows to the discharging guide device. In this process, because the preheating temperature of the wall of the revolving pipe is far less than the temperature of the metal melt, the metal melt is chilled by the wall of the revolving pipe, the temperature of the high temperature metal melt continuously decreases, the metal melt is nucleated and the crystal grain increasingly grows up. Due to the strong stirring, the dendrites break up constantly, to yield isometric, fine, and uniform non-dendritic semi-solid slurry, which is discharged from the airtight exit door. After the pouring is completed, the pouring ladle is removed from the airtight entrance door, no signal can be detected by the opposite-type sensor, and the drive cylinders drive the airtight entrance door and the airtight exit door to close synchronously. In the entire preparation process of slurry, the seal box is filled with protective gas having certain pressures all along, the external air is prevented from entering the seal box, so that the entire process is clean and suffers no contamination. In addition, the angle adjustment bracket can adjust the angle between the revolving pipe and horizontal plane, and the servo motor can adjust the rotation speed or swing speed of the revolving pipe, thus conveniently controlling the technological parameters.

Advantages of the device for producing semi-solid slurry according to embodiments of the invention are summarized as follows. The height adjustment mechanism and the position adjustment mechanism can ensure the device to work at an appropriate working position. The angle adjustment bracket can adjust the angle between the revolving pipe and horizontal plane, thus conveniently controlling the technological parameters. The arrangement of the thermal-adaptation elastic support can prevent the roller bearings supporting the revolving pipe from jamming due to thermal expansion, so that the device of the invention can work free of thermal influence. The servo motor and the bevel gear of the driving mechanism of the revolving pipe ensure the smooth and precise rotation of the revolving pipe, and the revolving pipe can rotate or swing at a large speed and angle. The melt protection mechanism ensures the entire manufacturing process is carried out in a closed space filled with protective gas with certain pressures, so that the entire process is clean and suffers no air contamination.

The device for producing semi-solid slurry of the invention can produce semi-solid slurry continuously, efficiently, and causes no contamination, and thus the production efficiency and the quality of the semi-solid slurry are greatly improved.

BRIEF DESCRIPTION OF THE DRAWINGS

The invention is described hereinbelow with reference to the accompanying drawings, in which.

Figure 1:
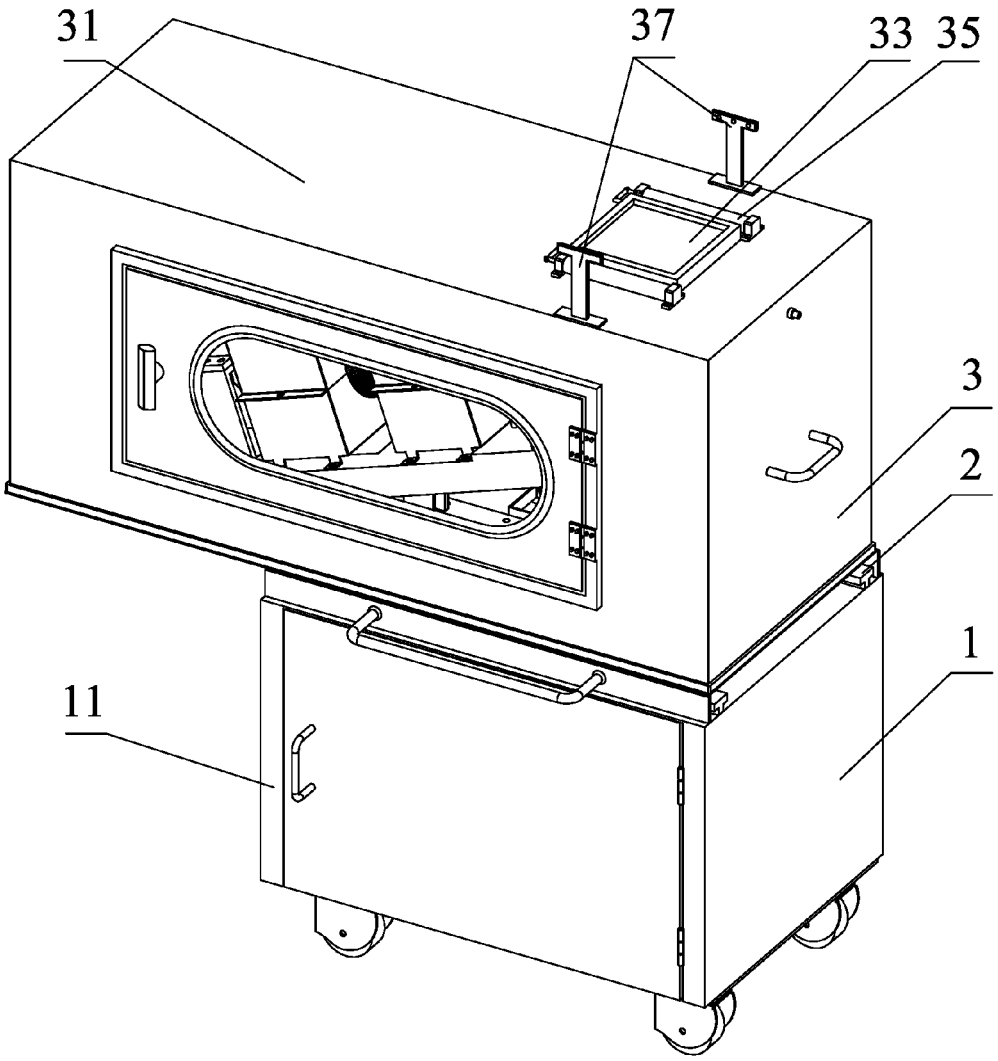
FIG. 1 is a stereogram of a device for producing semi-solid slurry in accordance with one embodiment of the invention.
Figure 2:
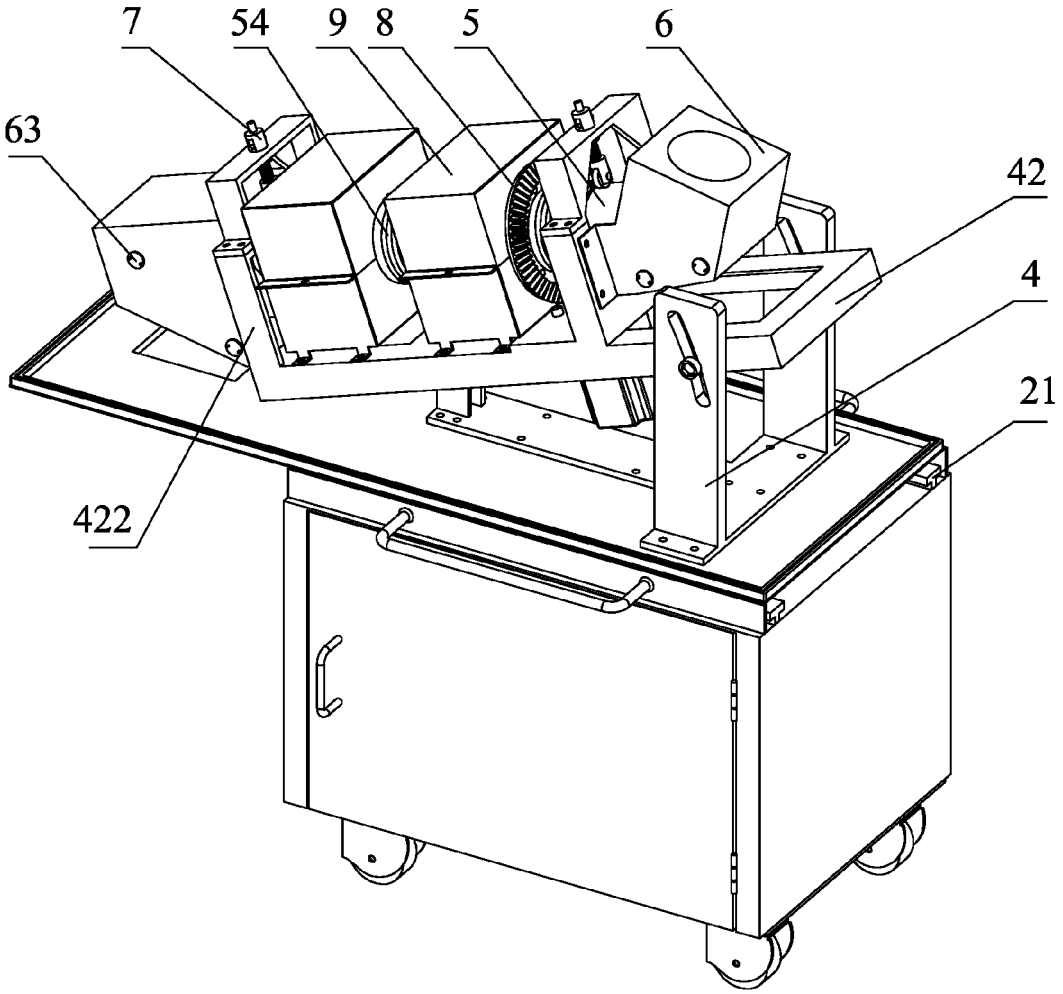
FIG. 2 is a stereogram of a device for producing semi-solid slurry in a naked state after a shell of the seal box is removed in accordance with one embodiment of the invention.
Figure 3:
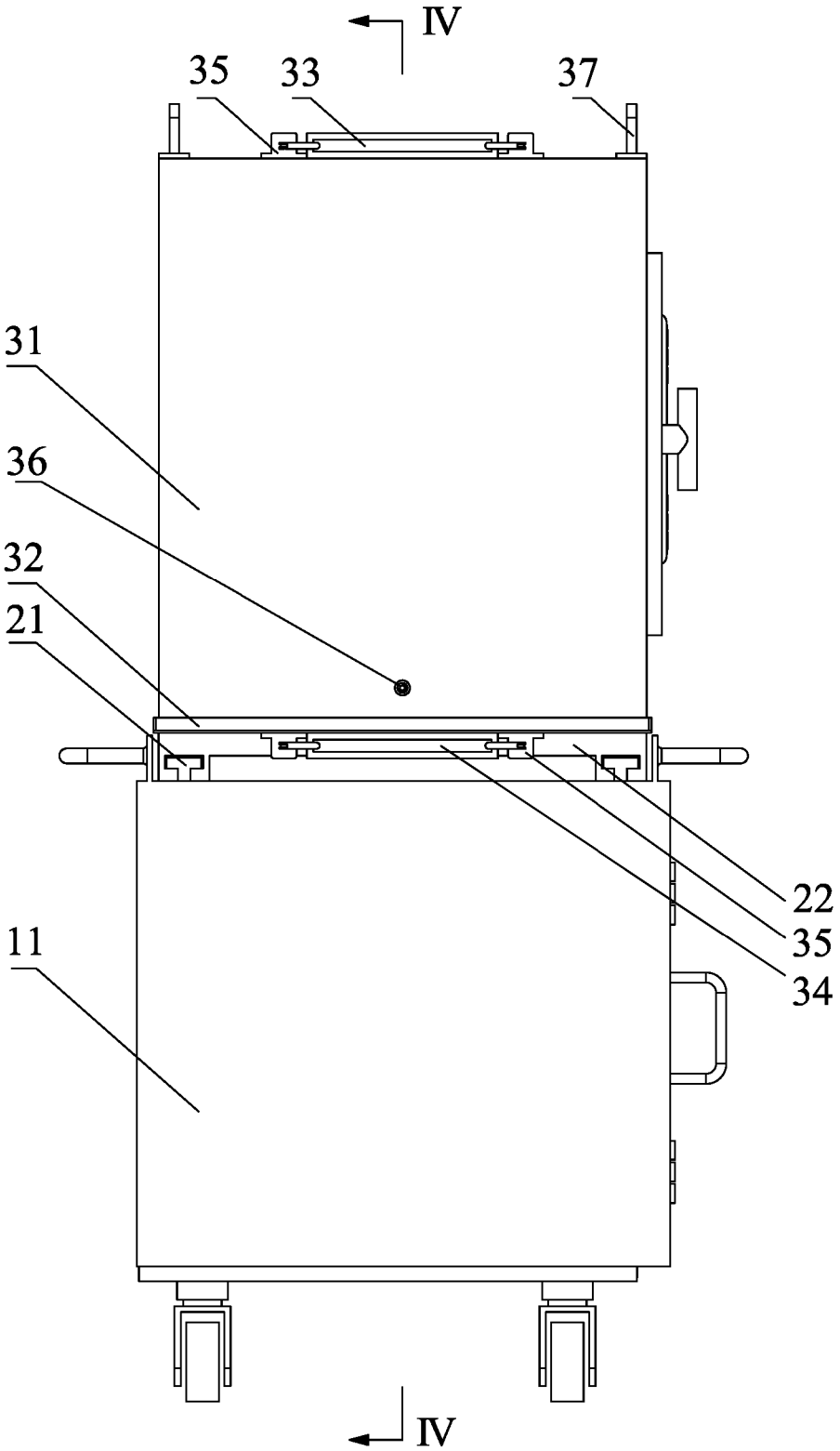
FIG. 3 is a front view of a device for producing semi-solid slurry in accordance with one embodiment of the invention.
Figure 4:
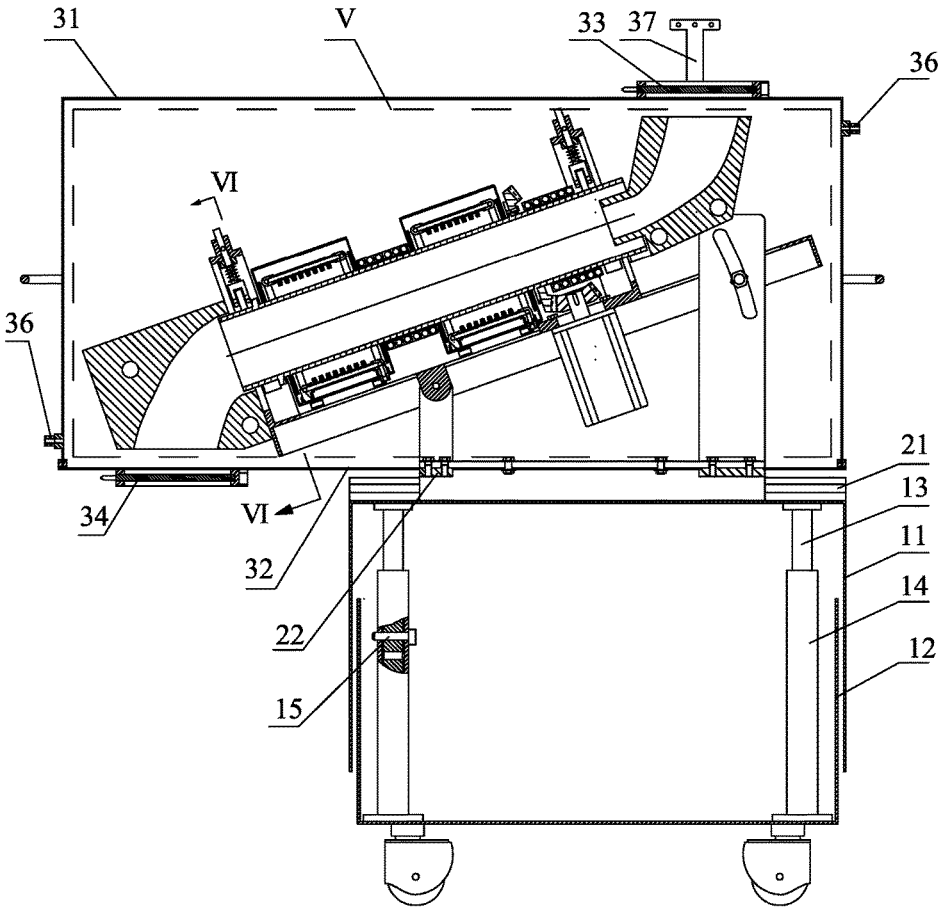
FIG. 4 is a sectional view of a device for producing semi-solid slurry in FIG. 3 taken from line IV-IV.
Figure 5:
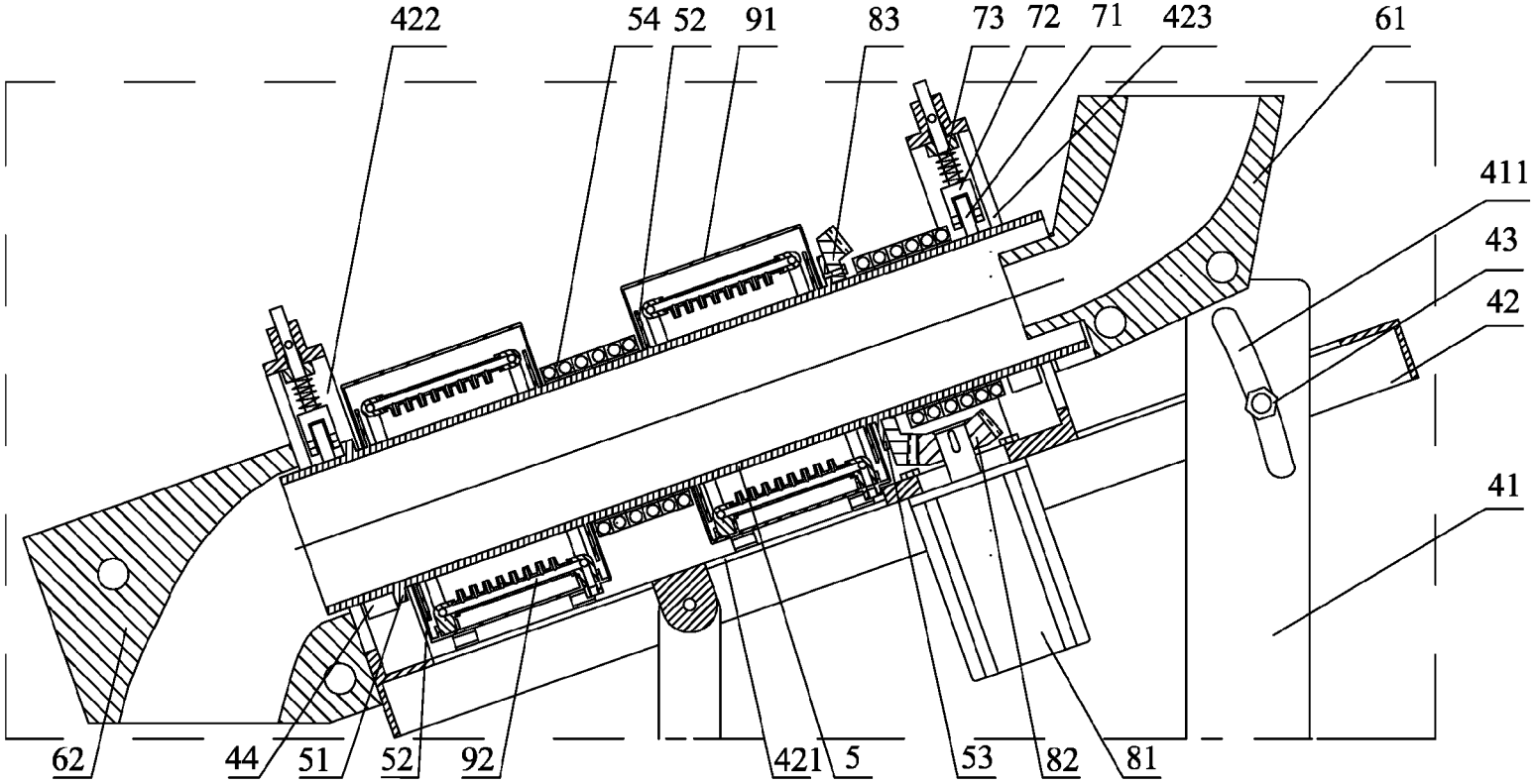
FIG. 5 is a local enlarged view of part V in FIG. 4.
Figure 6:
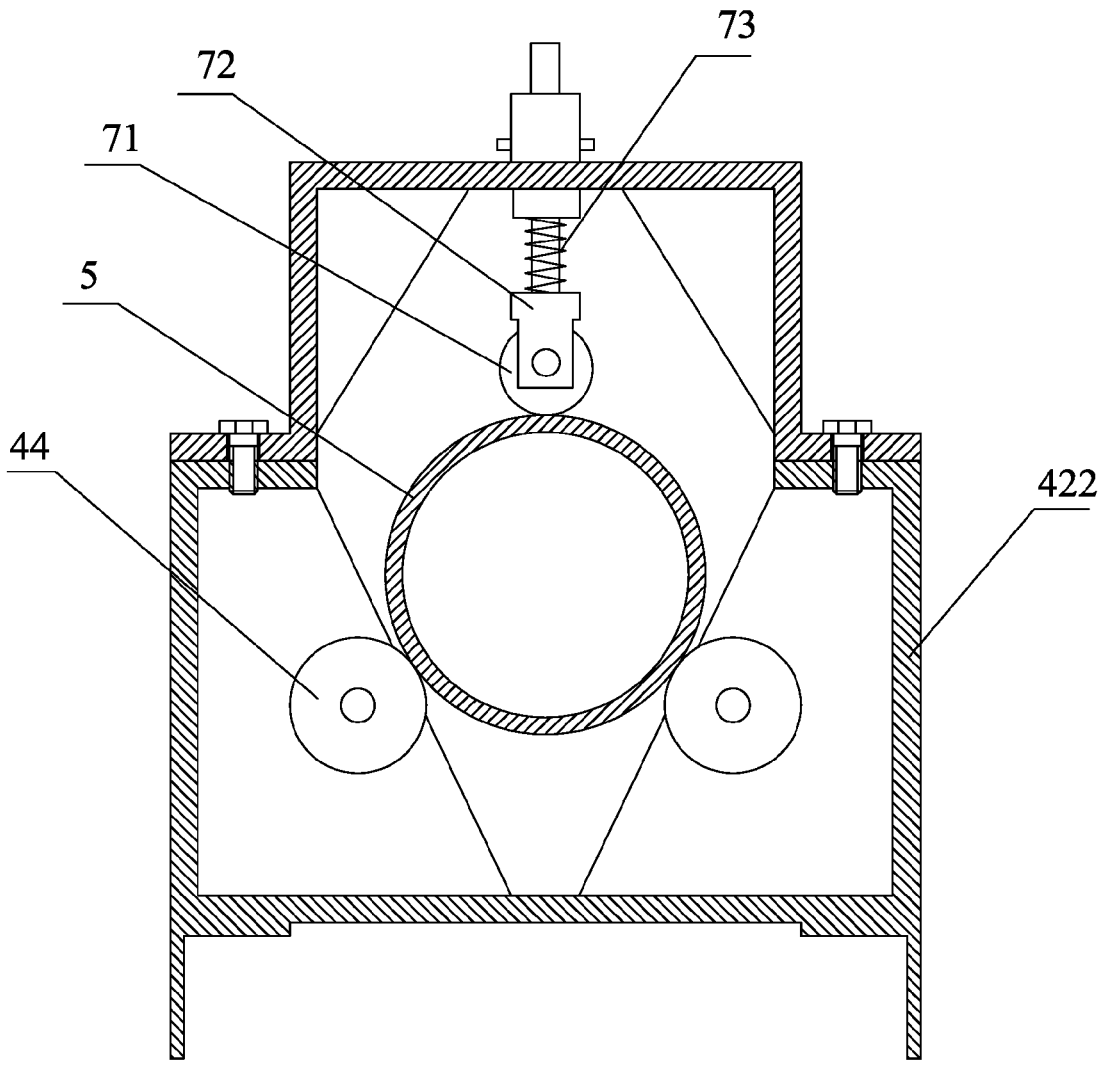
FIG. 6 is a sectional view of a device for producing semi-solid slurry in FIG. 4 taken from line VI-VI.

In the drawings, the following reference numbers are used: 1. Height adjustment mechanism; 11. Upper casing; 12. Lower casing; 13. Guide pillar; 14. Guide sleeve; 15. Location pin; 2. Position adjustment mechanism; 21. Stationary rail; 22. Moving rail support; 3. Melt protection mechanism; 31. shell; 32. Base plate; 33. Airtight entrance door; 34. Airtight exit door; 35. Drive cylinder; 36. Air inlet; 37. Opposite-type sensor; 4. Support mechanism; 41 Main support frame; 411. Arc groove; 42. Angle adjustment bracket; 421. Installation platform; 422. Front pillar; 423. Rear pillar; 43. positioning bolt; 44. Guide wheel; 5. Revolving pipe; 51. Axial locating disc; 52; Water fender; 53. Gear mounting plate; 54. Heating ring; 6. Guide mechanism; 61. Feeding guide device; 62. Discharging guide device; 63. Heating resistor; 7. Thermal-adaptation elastic support; 71. Elastic guide wheel; 72. Wheel support; 73. Fixed support; 8. Driving mechanism; 81. Servo motor; 82. Bevel pinion; 83. Bevel gear; 9. Cooling module; 91. Cooling water tank; 92. Spray pipe.

DETAILED DESCRIPTION OF THE EMBODIMENTS

For further illustrating the invention, experiments detailing a device for producing semi-solid slurry are described below. It should be noted that the following examples are intended to describe and not to limit the invention.

The invention provides a device for producing semi-solid slurry comprising a height adjustment mechanism 1, a position adjustment mechanism 2, a melt protection mechanism 3, a support mechanism 4, a revolving pipe 5, guide mechanisms 6, thermal-adaptation elastic supports 7, a driving mechanism 8 for driving the revolving pipe 5, and a cooling module 9. The support mechanism 4, the revolving pipe 5, the guide mechanisms 6, the thermal-adaptation elastic supports 7, the driving mechanism 8 for driving the revolving pipe 5, and the cooling module 9 are disposed in the melt protection mechanism 3.

The height adjustment mechanism 1 is a box structure comprising an upper casing 11 and a lower casing 12. The upper casing 11 and the lower casing 12 of the height adjustment mechanism are fixed together through guide pillars 13, guide sleeves 14, and location pins 15. The guide pillars 13 comprise location holes with different vertical height. Through inserting the location pins 15 into the corresponding location holes of the guide pillars, the height of the device for producing semi-solid slurry is adjusted.

The position adjustment mechanism 2 comprising a stationary rail 21 and a moving rail support 22. The stationary rail 21 and the moving rail support 22 constitute a guide pair, so as to adjust the position of the device for producing semi-solid slurry in the working platform.

The support mechanism 4 comprising a main support frame 41 and an angle adjustment bracket 42, the main support frame 41 is fixed on the base plate 32 of the seal box. The angle adjustment bracket 42 comprises a front end and a rear end, the front end is hinged to the main support frame 41, and the rear end is fixed on an arc groove 411 of the main support frame 41 via a positioning bolt 43. By adjusting the position of the positioning bolt 43 in the arc groove 411, the angle between the installation platform 421 of the revolving pipe and horizontal plane is adjusted.

The revolving pipe 5 is supported by a support system comprising a front pillar 422, a rear pillar 423, and four guide wheels 44; the four guide wheels 44 is hinged to the front pillar 422 and the rear pillar 423, respectively; the revolving pipe 5 being supported by the four guide wheels 44 and tilted. An axial locating disc 51 is soldered on the revolving pipe 5 to axially locate the revolving pipe 5; one side face of each of two guide wheels hinged to the front pillar 422 contacts one side face of the axial locating disc 51; and heating rings 54 are sleeved on the outer wall of the revolving pipe in sections.

The guide mechanisms 6 comprise a feeding guide device 61 and a discharging guide device 62; the feeding guide device 61 is fixed on the rear pillar 423 and communicates with the material inlet of the revolving pipe, and comprises a first heating resistor 63 inside; the discharging guide device 62 is fixed on the front pillar 422 and communicates with the material outlet of the revolving pipe, and comprises a second heating resistor 63 inside.

The driving mechanism 8 for driving the revolving pipe comprises a servo motor 81 fixed on the installation platform 421 of the angle adjustment bracket 42, a bevel pinion 82 disposed on a rotating shaft of the servo motor 81, and a bevel gear 83 disposed on a gear mounting plate 53 soldered on the revolving pipe 5. The servo motor and the bevel gear of the driving mechanism of the revolving pipe ensure the smooth and precise rotation of the revolving pipe, and the revolving pipe can rotate or swing at a large speed and angle.

The thermal-adaptation elastic supports comprises an elastic guide wheel 71, a wheel support 72, and a fixed support 73 of the elastic guide wheel 71; the elastic guide wheel 71 is hinged to the fixed support 73 and contacts the outer wall of the revolving pipe 5; the wheel support 72 is disposed on the fixed support 73; the fixed support 73 of the elastic guide wheel 71 is fixed on the front pillar 422 and the rear pillar 423. The arrangement of the thermal-adaptation elastic support can prevent the roller bearings supporting the revolving pipe from jamming due to thermal expansion, so that the device of the invention can work free of thermal influence.

The seal box of the melt protection mechanism 3 further comprises a shell 31, an airtight entrance door 33 and an airtight exit door 34; the base plate 32 and the moving rail support 22 are integrated through soldering; the airtight exit door 34 is located at a front end of the base plate 32; the shell 31 and the base plate are assembled to form a seal box body, two opposite sides of the seal box body are provided with two air inlets 36, respectively; the airtight entrance door 33 is disposed on an upper surface of the cove; one side of the entrance door 33 and one side of the airtight exit door 34 each are provided with a drive cylinder 35. In the entire preparation process of slurry, the seal box is filled with protective gas having certain pressures all along, the external air is prevented from entering the seal box, so that the entire process is clean and suffers no contamination.

The cooling module 9 comprises a cooling water tank 91, a spray pipe 92, and a water fender 52; the cooling water tank 91 is fixed on the installation platform 421 along the axial direction of the revolving pipe 5; the spray pipe 92 is disposed in the cooling water tank 91 along a circumferential direction of the revolving pipe 5; and the water fender 52 is soldered on the revolving pipe 5. The design can prevent the cooling water from ejecting out from the gap between the cooling water tank 91 and the revolving pipe 5, or prevent the water from splashing into the high temperature slurry, thus eliminating the hidden risks.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A device for producing semi-solid slurry, comprising:

a height adjustment mechanism, the height adjustment mechanism being a box structure comprising an upper casing and a lower casing;

a position adjustment mechanism, the position adjustment mechanism comprising a stationary rail and a moving rail support, the stationary rail being fixed on the upper casing of the height adjustment mechanism;

a melt protection mechanism, the melt protection mechanism comprising a seal box comprising a base plate fixed on the moving rail support;

a support mechanism, the support mechanism comprising a main support frame and an angle adjustment bracket, the main support frame being fixed on the base plate of the seal box, and the angle adjustment bracket being mounted on the main support frame;

a revolving pipe, the revolving pipe comprising a material inlet and a material outlet and being supported by a support system, the support system comprising a front pillar, a rear pillar, and four guide wheels;

the four guide wheels being hinged to the front pillar and the rear pillar, respectively;

the revolving pipe being supported by the four guide wheels and tilted so that one end of the revolving pipe closed to the material inlet is higher than another end of the revolving pipe closed to the material outlet;

the front pillar and the rear pillar being fixed on an installation platform of the angle adjustment bracket;

guide mechanisms, the guide mechanisms being disposed on the front pillar and the rear pillar, and communicating with the material inlet and the material outlet of the revolving pipe, respectively;

thermal-adaptation elastic supports which is free of thermal expansion, the thermal-adaptation elastic supports being disposed on the front pillar and the rear pillar, respectively, the thermal-adaptation elastic supports comprising an elastic guide wheel which is in an elastic contact with an outer wall of the revolving pipe;

a driving mechanism for driving the revolving pipe, the driving mechanism being fixed on the installation platform and connected to and driving the revolving pipe; and a cooling module, the cooling module being disposed on the installation platform and distributed along an axial direction of the revolving pipe.

2. The device of claim 1, wherein the upper casing and the lower casing of the height adjustment mechanism are fixed together through guide pillars, guide sleeves, and location pins.

3. The device of claim 1, wherein the moving rail support is soldered on the base plate of the seal box; and the stationary rail and the moving rail support constitute a guide pair.

4. The device of claim 1, wherein the seal box of the melt protection mechanism further comprises a shell, an airtight entrance door, and an airtight exit door; the base plate and the moving rail support are integrated through soldering; the airtight exit door is located at a front end of the base plate; the shell and the base plate are assembled to form a seal box body, two opposite sides of the seal box body are provided with two air inlets, respectively; the airtight entrance door is disposed on an upper surface of a cove; one side of the entrance door and one side of the airtight exit door each are provided with a drive cylinder.

5. The device of claim 1, wherein the angle adjustment bracket comprises a front end and a rear end, the front end is hinged to the main support frame via a pin, and the rear end is fixed in an arc groove of the main support frame via a positioning bolt.

6. The device of claim 1, wherein an axial locating disc is soldered on the revolving pipe to axially locate the revolving pipe; one side face of each of two guide wheels hinged to the front pillar contacts one side face of the axial locating disc; and heating rings are sleeved on the outer wall of the revolving pipe in sections.

7. The device of claim 1, wherein the guide mechanisms comprise a feeding guide device and a discharging guide device; the feeding guide device is fixed on the rear pillar and communicates with the material inlet of the revolving pipe, and comprises a first heating resistor inside; the discharging guide device is fixed on the front pillar and communicates with the material outlet of the revolving pipe, and comprises a second heating resistor inside.

8. The device of claim 1, wherein the driving mechanism for driving the revolving pipe comprises a servo motor fixed on the angle adjustment bracket, a bevel pinion disposed on a rotating shaft of the servo motor, and a bevel gear disposed on a gear mounting plate soldered on the revolving pipe.

9. The device of claim 1, wherein the thermal-adaptation elastic supports are two in number and are disposed on the front pillar and the rear pillar, respectively; each thermal-adaptation elastic support comprises the elastic guide wheel, a wheel support, and a fixed support of the elastic guide wheel; the elastic guide wheel is hinged to the fixed support and contacts the outer wall of the revolving pipe; the wheel support is disposed on the fixed support; the fixed support of the elastic guide wheel is fixed on the front pillar and the rear pillar.

10. The device of claim 1, wherein two sets of the cooling module are fixed in segments on the installation platform along the axial direction of the revolving pipe; the cooling module comprises a cooling water tank, a spray pipe, and a water fender; the cooling water tank is fixed on the installation platform along the axial direction of the revolving pipe; the spray pipe is disposed in the cooling water tank along a circumferential direction of the revolving pipe; and the water fender is soldered on the revolving pipe.

* * * * *